US005846344A

United States Patent [19]

Kawaguchi et al.

[11] Patent Number: 5,846,344

[45] Date of Patent: Dec. 8, 1998

[54] SPRING STEEL OF HIGH STRENGTH AND HIGH CORROSION RESISTANCE

[75] Inventors: Yasunobu Kawaguchi; Masataka Shimotsusa; Kan Momozaki; Takenori Nakayama; Shigeaki Miyauchi; Yoshinori Yamamoto; Norio Ohkouchi, all of Kobe, Japan

[73] Assignee: Kabushiki Kaisha Kobe Seiko Sho, Kobe, Japan

[21] Appl. No.: 592,546

[22] Filed: Jan. 26, 1996

Related U.S. Application Data

[63] Continuation of Ser. No. 335,346, Nov. 3, 1994, Pat. No. 5,508,002.

[30] Foreign Application Priority Data

Nov. 4, 1993 [JP] Japan ..... 5-275514
Aug. 29, 1994 [JP] Japan ..... 6-203719

[51] Int. Cl.[6] ..... C22C 38/20; C22C 38/40

[52] U.S. Cl. ..... 148/333; 148/334; 148/335; 148/908

[58] Field of Search ..... 148/335, 334, 148/333, 908

[56] References Cited

U.S. PATENT DOCUMENTS 5,183,634 2/1993 Abe et al. .
5,286,312 2/1994 Shimotsusa et al. .
5,302,216 4/1994 Sugita et al. .
5,508,002 4/1996 Kawaguchi et al. ..... 420/112

FOREIGN PATENT DOCUMENTS 2044639 12/1991 Canada .

OTHER PUBLICATIONS

Patent Abstracts of Japan, vol. 13, No. 472 (C–647) Oct. 25, 1989 and JP–A–01 184 259, Suzuki Shinichi.

*Primary Examiner*—Deborah Yee
*Attorney, Agent, or Firm*—Oblon, Spivak, McClelland, Maier & Neustadt, P.C.

[57] ABSTRACT

Disclosed is a spring steel for a high corrosion resistant and high strength, which exhibits an excellent drawability without softening heat treatment after hot rolling, and which has a strength of 1900 MPa or more by quenching and tempering and an excellent corrosion resistance. The spring steel contains elements of C, Si, Mn and Cr, and elements of Ni and/or Mo in suitable amounts, the balance being essentially Fe and inevitable impurities, wherein the elements satisfy the following requirement:

$$2.5 \leqq (FP) \leqq 4.5$$

$$2.0 \leqq (FP/\log D) \leqq 4.0$$

where D is a diameter (mm) of the rolled material, and FP=(0.23[C]+0.1)×(0.7[Si]+1)×(3.5[Mn]+1) ×(2.2[Cr]+1)×(0.4[Ni]+1)×(3[Mo]+1) in which [element] represents mass % of the element.

104 Claims, 4 Drawing Sheets

SPRING STEEL OF HIGH STRENGTH AND HIGH CORROSION RESISTANCE

This is a Continuation of application Ser. No. 08/335,346 filed on Nov. 3, 1994, now U.S. Pat. No. 5,508,002.

BACKGROUND OF THE INVENTION

1. Field of the Invention

The present invention relates to a spring steel for a high strength spring which is used for a valve spring of an internal combustion engine, a suspension spring and the like, and particularly to a spring steel for a high strength spring capable of being drawn or peeled without annealing after hot rolling, which nevertheless sufficiently satisfies the strength (hardness) after quenching and tempering required as one of important spring characteristics and also exhibits the excellent corrosion resistance required for a suspension spring. The wording "spring steel" of the present invention includes not only a steel wire, wire rod or bar before being formed into a spring but also a spring as the final product.

2. Description of the Related Art

The chemical compositions of spring steels are specified in JIS G3565 to 3567, 4801 and the like. By use of these spring steels, various springs are manufactured by the steps of: hot-rolling each spring steel into a hot-rolled wire rod or bar (hereinafter, referred to as "rolled material"); and drawing the rolled material to a specified diameter and then cold forming the wire into a spring after oil-tempering, or drawing the rolled material or peeling and straightening the rolled material, heating and forming the wire into a spring, and quenching and tempering it. Recently, there have been strong demands toward the characteristics of springs, and to meet these demands, alloy steels subjected to heat treatment have been extensively used as the materials of the springs.

In manufacture of a spring, a rolled material may be subjected to drawing directly after descaling. However, in the case where the rolled material has a high strength more than about 1350 MPa, it causes problems of breakage, seizure and bending during the drawing, or it causes a problem of the reduced tool life in the peeling; accordingly, it requires a softening heat treatment such as annealing. The softening heat treatment such as annealing, however, causes an inconvenience in increasing the manufacturing cost due to an increase in the processing step.

On the other hand, there is a tendency in the field of automobile toward the enhancement of the stress of a spring as a part of measures of achieving lightweightness for reducing exhaust gas and fuel consumption. Namely, in the field of automobile, there is required a spring steel for a high strength spring which has a strength after quenching and tempering of 1900 MPa or more. However, as the strength of a spring is enhanced, the sensitivity against defects is generally increased. In particular, the high strength spring used in a corrosion environment is deteriorated in corrosion fatigue life, and is fear of early causing the breakage. The reason why corrosion fatigue life is reduced is that corrosion pits on the surface of a spring act as stress concentration sources which accelerate the generation and propagation of fatigue cracks. To prevent the reduction of corrosion fatigue life, corrosion resistance must be improved by the addition of elements such as Si, Cr and Ni. However, these elements are also effective to enhance hardenability, and thereby they produce a supercooling structure (martensite, bainite, etc.) in the rolled material when being added in large amounts. This requires a softening heat treatment such as annealing, and which fails to solve the problems in increasing the processing step thereby increasing the manufacturing cost and reducing the productivity.

SUMMARY OF THE INVENTION

An object of the present invention is to provide a spring steel for a high strength spring capable of omitting annealing after hot rolling and directly performing cold-working such as drawing and peeling, which nevertheless exhibits a high strength after quenching and tempering of 1900 MPa or more and an excellent corrosion resistance.

To achieve the above object, according to the present invention, there is provided a spring steel of high strength and high corrosion resistance containing:

C: 0.3–0.6 mass % (hereinafter, referred to as %),

Si: 1.0–3.0%,

Mn: 0.1–0.5%,

Cr: 0.5–1.5%, and

Ni: 1.0% or less (excluding 0%) and/or Mo: 0.1–0.5%, the balance being essentially Fe and inevitable impurities, wherein the above components satisfy the following requirement:

$$2.5 \leqq (FP) \leqq 4.5 \quad \text{(Ia)}$$

where $FP=(0.23[C]+0.1)\times(0.7[Si]+1)\times(3.5[Mn]+1)\times(2.2[Cr]+1)\times(0.4[Ni]+1)\times(3[Mo]+1)$ in which [element] represents % of the element.

The above spring steel may further contains 0.1–1.0% of Cu; or at least one kind selected from a group consisting of 0.01–0.5% of V, 0.01–1.0% of Nb, 0.01–1.0% of Al and 0.01–1.0% of Ti; or 0.1–3.0% of Co and/or 0.1–1.0% of W; or at least one kind selected from a group consisting of 0.001–0.1% of Ca, 0.001–1.0% of La, and 0.001–1.0% of Ce.

In the case where the above spring steel is a steel bar or steel wire obtained by hot rolling, to further achieve the performance, the composition may be adjusted to satisfy the following requirement:

$$2.0 \leqq (FP/\log D) \leqq 4.0 \quad \text{(Ib)}$$

where D is a diameter (mm) of the steel bar or steel wire after hot rolling, and $FP=(0.23[C]+0.1)\times(0.7[Si]+1)\times(3.5[Mn]+1)\times(2.2[Cr]+1)\times(0.4[Ni]+1)\times(3[Mo]+1)$.

In the spring steel of satisfying the above requirements, to obtain the further improved cold workability, the tensile strength of a rolled material after hot rolling may be 1350 MPa or less; 90% or more of the cross-section of the metal structure may be composed of a ferrite/pearlite structure or pearlite structure; and the nodule size number of the pearlite structure may be 6 or more. Such a spring steel can be subjected to drawing or peeling as it is without annealing after hot rolling, and can provide a spring having a high strength after quenching and tempering and an excellent corrosion resistance. The above rolled material specified in the tensile strength, metal structure and nodule size number can be positively obtained under the conditions that the starting temperature of hot rolling is in the range from 850° to 1050° C.; the cooling starting temperature after hot rolling is in the range from 700° to 900° C.; and the average cooling rate from the cooling starting temperature to 500° C. is in the range from 0.5°–3.0° C./sec.

DETAILED DESCRIPTION OF THE PREFERRED EMBODIMENTS

Figure 1:
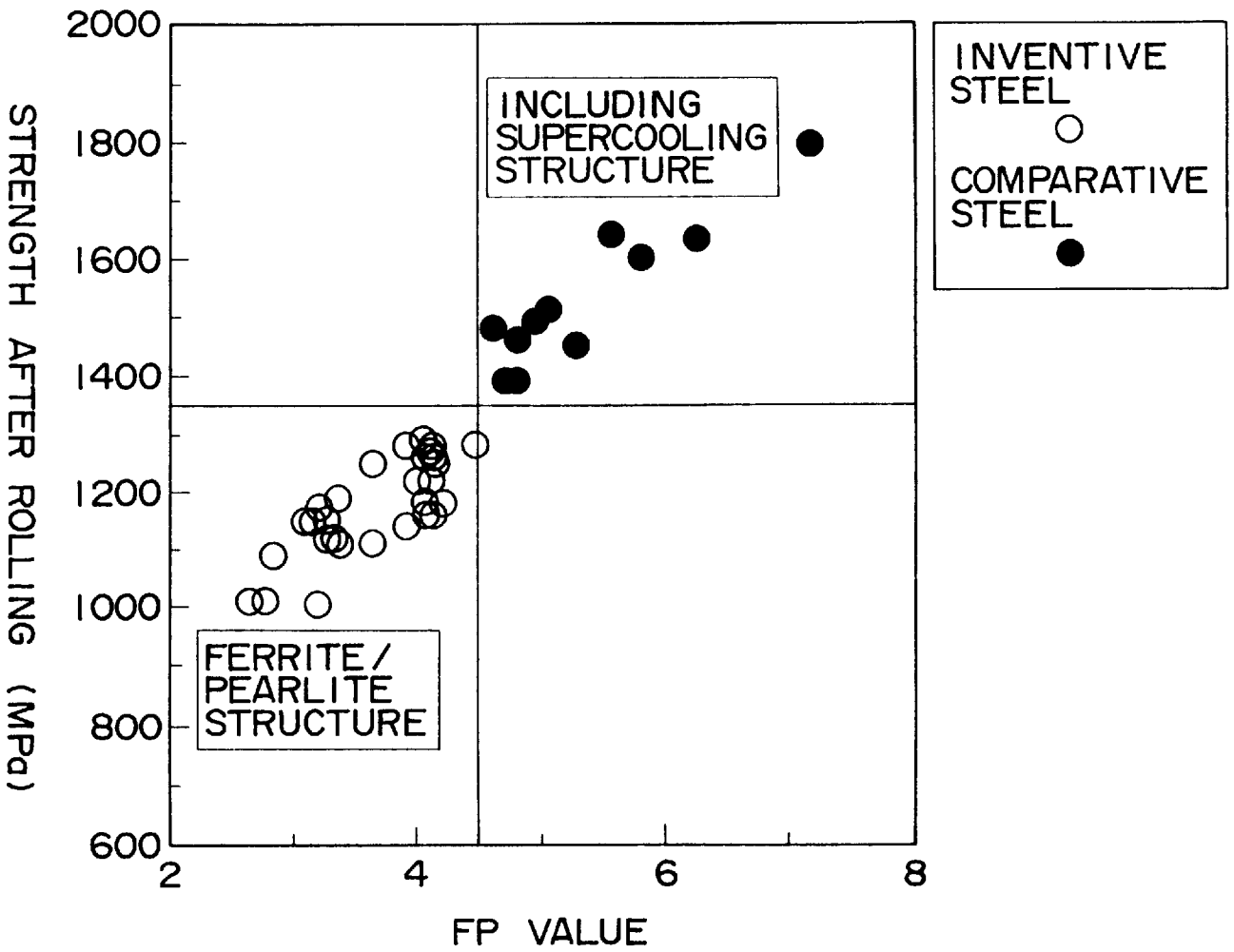
FIG. 1 is a graph showing the relationship between the (FP value) and the strength after rolling with respect to a steel bar/wire.

In order to enhance the fatigue life of a spring, it is required to improve the strength after quenching and tempering of a spring steel for spring and to enhance the toughness of the material. To enhance the elastic limit after quenching and tempering, the conventional spring steel for spring contains carbon in a relatively large amount; but, from the viewpoint of ensuring or improving the toughness of the material, it is effective to rather reduce the carbon content. The reduction in the carbon content, however, lowers the strength (hardness) after quenching and tempering and cannot satisfy the required strength of 1900 MPa or more. Accordingly, the reduction of carbon content is naturally limited, and the alloy elements such as Si and Cr must be added.

In the general spring steel for spring, as is well known, the corrosion fatigue life is reduced as the strength after quenching and tempering is increased. The corrosion fatigue of a spring is generated as follows: namely, corrosion pits are produced on the surface of the spring in a corrosive environment (salinity, water content, mud and the like), and the fatigue cracks are generated due to the stress concentration generated at the bottom portions of the pits and are propagated. Accordingly, to improve the corrosion fatigue life, it is required to enhance the corrosion resistance of the spring steel for spring and hence to suppress the generation and growth of corrosion pits, and therefore, it is required to add the elements for enhancing corrosion resistance such as Si, Cr and Ni.

The addition of Si, Cr and Ni is effective to improve the strength (hardness) after quenching and tempering and corrosion resistance. However, when these elements are added in large amounts, there occurs a disadvantage that a supercooling structure (martensite and bainite) emerges upon hot rolling and the strength after rolling is increased up to 1350 MPa. This tends to generate the breakage, seizure and bending of the wire in the subsequent drawing step, or to reduce the tool life upon peeling. As a result, the softening heat treatment such as annealing is required to be applied after hot rolling as described above, thus increasing the manufacturing steps and the manufacturing cost. The strength after rolling, therefore, must be suppressed to be 1350 MPa or less (the structure of the rolled material is ferrite/pearlite or pearlite structure). In this regard, the added amounts of alloy elements are naturally limited, and the suitable adjustment of the composition becomes significantly important.

According to the present invention, in the composition containing strengthening elements and corrosion resistance improving elements in suitable amounts, there is a requirement that the metal structure after hot rolling is made to be the ferrite/pearlite or pearlite structure for suppressing the tensile strength of a rolled material to be 1350 MPa or less thereby omitting the softening heat treatment performed prior to the cold-working such as drawing and peeling, and for obtaining a high strength of 1900 MPa or more by the subsequent quenching and tempering and ensuring a high corrosion resistance. To meet the above requirement, the chemical composition of a spring steel is specified as described later, and particularly, from the viewpoint of suppressing a supercooling structure upon hot rolling, the above-described equations (Ia) and (Ib) are specified.

First, the reason why the chemical composition of a steel used in the present invention is specified will be described.

C: 0.3 to 0.6%

C is an essential element for ensuring the tensile strength (hardness) after quenching and tempering. When the C content is less than 0.3%, the strength (hardness) after quenching and tempering becomes insufficient. When it is more than 0.6%, the toughness and ductility after quenching and tempering is deteriorated, and also the corrosion resistance is lowered. Accordingly, the upper limit of the C content is specified at 0.6%. From the viewpoint of the strength and corrosion resistance, the C content is preferably in the range from 0.3 to 0.5%.

Si: 1.0 to 3.0%

Si is an essential element for reinforcing the solid solution. When the Si content is less than 1.0%, the strength of the matrix after quenching and tempering becomes insufficient. When the Si content is more than 3.0%, the solution of carbides becomes insufficient upon heating for quenching, and the uniform austenitizing requires the heating at a high temperature, which excessively accelerates the decarbonization on the surface, thereby deteriorating the fatigue characteristics of a spring. The Si content is preferably in the range from 1.4 to 2.5%.

Mn: 0.1 to 0.5%

Mn is an element for improving the hardenability. To achieve this function, Mn must be added in an amount of 1.0% or more. However, when the Mn content is more than 0.5%, the hardenability is excessively increased, which tends to generate a supercooling structure upon rolling.

Cr: 0.5 to 1.5%

Cr is an element to make amorphous and dense the rust produced on the surface layer in a corrosive environment thereby improving the corrosion resistance, and to improve the hardenability like Mn. To achieve these functions, Cr must be added in an amount of 0.5% or more. However, when the Cr content is more than 1.5%, the hardenability is excessively increased, which tends to generate a supercooling structure after rolling. Accordingly, the Cr content is preferably in the range from 0.7 to 1.3%.

Ni: 1% or less (excluding 0%)

Ni is an element for enhancing the toughness of the material after quenching and tempering, making amorphous and dense the produced rust thereby improving the corrosion resistance, and improving the sag resistance as one of important spring characteristics. To achieve these functions, Ni must be added in a slight amount, preferably, 0.1% or more. When the Ni content is more than 1.0%, the hardenability is excessively increased, and a supercooling structure is easily generated after rolling. The Ni content is preferably in the range from 0.3 to 0.8%.

Mo: 0.1 to 0.5%

Mo is an element for improving the hardenability, and enhancing the corrosion resistance due to the absorption of molybdate ion produced in corrosive solution. To achieve these functions, Mo must be added in an amount of 0.1% or more. However, when the Mo content is more than 0.5%, the hardenability is excessively increased, and a supercooling structure is generated after rolling, which exerts an adverse effect on the drawability and peeling-ability. The Mo content is preferably in the range from 0.1 to 0.3%.

The above elements, Ni and Mo, are both effective to improve the corrosion resistance, and either or both thereof may be added. However, Ni is superior to Mo in the effect of improving the corrosion resistance, and therefore, from the viewpoint of the corrosion resistance, it is desirable to add Ni.

The bar/wire for a high strength spring of the present invention mainly contains the above elements, and the balance is essentially Fe and inevitable impurities. However, it may further contain (1) Cu, (2) at least one kind of V, Nb, Al, Ti, (3) Co and/or W, and (4) at least one kind of Ca, La, and Ce, in a manner to be independent or to be in combination with each other. The desirable content of each of these elements is as follows:

Cu: 0.1 to 1.0%

Cu is an element being electrochemically noble more than Fe, and has a function to enhance the corrosion resistance. To achieve this function, Cu must be added in an amount of 0.1% or more. However, even when the Cu content is more than 1.0%, the effect is saturated, or rather, there occurs a fear of causing the embrittlement of the material during hot rolling. The Cu content is preferably in the range from 0.1 to 0.3%.

V: 0.01 to 0.5%

V is an element for refining the grain size and enhancing the proof stress ratio thereby improving the sag resistance. To achieve this function, V must be added in an amount of 0.01% or more. However, when the V content is more than 0.5%, the amount of carbides of alloys not to be dissolved in solid in the austenite phase during heating for quenching is increased, and the carbides remain as the large massive particles thereby lowering the fatigue life. The V content is preferably in the range from 0.05 to 0.2%.

Nb: 0.01 to 1.0%

Nb is an element for refining the grain size and enhancing the proof stress ratio thereby improving the sag resistance, like V. To achieve this function, Nb must be added in an amount of 0.01% or more. However, even when the Nb content is more than 1.0%, the effect is saturated, or rather, coarse carbides/nitrides remain during heating for quenching, which exerts an adverse effect on the fatigue life. The Nb content is preferably in the range from 0.01 to 0.3%.

Al: 0.01 to 1.0%

Al is an element for refining the grain size and enhancing the proof stress ratio thereby improving the sag resistance, like Nb. To achieve this function, Al must be added in an amount of 0.01% or more. However, even when the Al content is more than 1.0%, the effect is saturated, or rather, the amount of coarse oxide based inclusions is increased thereby deteriorating the fatigue life. The Al content is preferably in the range from 0.01 to 0.3%.

Ti: 0.01 to 1.0%

Ti is an element for refining the grain size and enhancing the proof stress ratio thereby improving the sag resistance, like Nb and Al. To achieve this function, Ti must be added in an amount of 0.01% or more. However, when the Ti content is more than 1.0%, coarse carbides/nitrides are produced, which exerts an adverse effect on the fatigue life. The Ti content is preferably in the range from 0.01 to 0.3%.

Co: 0.1 to 3.0%

Co is an element for enhancing the strength while suppressing the deterioration of the toughness, and improving the corrosion resistance. To achieve these functions, Co must be added in an amount of 0.1% or more. However, even when the Co content is more than 3.0%, the effect is saturated, and therefore, the excessive addition more than the content of 3.0% is undesirable in terms of the cost. The Co content is preferably in the range from 0.3 to 2.0%.

W: 0.1 to 1.0%

W is an element for enhancing the strength, like Co. To achieve this function, W must be added in an amount of 0.1% or more. However, the excessive addition deteriorates the toughness of the material. Accordingly, the W content must be suppressed to be 1.0% or less. The W content is preferably in the range from 0.2 to 0.5%. One kind selected from a group consisting of 0.001–0.1% of Ca, 0.001–1.0% of La and 0.001–1.0% of Ce Ca is a forcibly deoxidizing element, and has a function to refine oxide based inclusions in steel and to purify the steel, and further to improve the corrosion resistance. To achieve these functions, Ca must be added in an amount of 0.001% or more. However, even when the Ca content is more than 0.1%, the effect is saturated, or rather, there occurs a fear of damaging a furnace wall during steelmaking.

La and Ce are effective to enhance the corrosion resistance. The effect of improving the corrosion resistance is considered as follows: namely, when the corrosion of a steel proceeds, in a corrosion pit as the starting point of the corrosion fatigue, there occurs the following reaction:

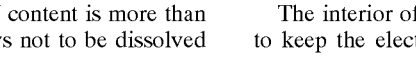

$$Fe \rightarrow Fe^{2+} + 2e^-$$

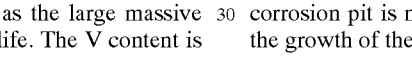

$$Fe^{2+} + 2H_2O \rightarrow Fe(OH)_2 + 2H^+$$

The interior of the corrosion pit is thus made acidic, and to keep the electric neutralization, $Cl^{-1}$ ions are collected therein from the exterior. As a result, the liquid in the corrosion pit is made severely corrosive, which accelerates the growth of the corrosion pit. When La and Ce are present in steel, they are dissolved in the liquid within the corrosion pit together with steel. However, since they are basic elements, the liquid thereof are made basic, to neutralize the liquid in the corrosion pit, thus significantly suppressing the growth of the corrosion pit as the starting point of the corrosion fatigue. To achieve this function, each of La and Ce must be added in an amount of 0.001% or more. However, even when the content is more than 1.0%, the effect is saturated and thereby the addition more than 1.0% is undesirable in terms of the cost. The Ca content is preferably in the range from 0.002 to 0.05%; the La content is preferably in the range from 0.005 to 0.2%; and the Ce content is preferably in the range from 0.005 to 0.2%.

In the present invention, to control the metal structure after hot rolling for suitably suppressing the strength thereby providing the excellent workability of cold working such as drawing and peeling as hot-rolled, and for sufficiently enhancing the strength after quenching and tempering and the corrosion resistance, there becomes very important the requirement specified in the above-described equations (Ia) and (Ib) in addition to the above requirement in terms of the chemical composition.

Namely, the requirement specified in the above equation (Ia) is essential to suppress the generation of a supercooling structure particularly in drawing the spring steel into a bar or wire, and to uniformly enhance the hardenability in quenching and tempering performed after cold working such as drawing and peeling. When the (FP) value is less than 2.5, the uniform hardening upon quenching and tempering cannot be obtained, that is, the sufficient strength cannot be obtained even if the spring steel satisfies the above requirement regarding the chemical composition. When the (FP) value is more than 4.5, a supercooling structure emerges after hot rolling, and the tensile strength of the rolled material becomes 1350 MPa or more, which requires the softening heat treatment prior to cold working, thus failing to achieve the object of the present invention. On the contrary, for the spring steel having the suitable (FP) value ranging from 2.5 to 4.5, any supercooling structure does not emerge after hot rolling, and the strength after rolling can be suppressed to be 1350 MPa or less, which enables the smooth cold working without any softening heat treatment; and uniform hardening is obtained by the subsequent quenching and tempering, which makes it possible to obtain the strength after quenching and tempering being 1900 MPa or more.

In addition, the reason why the diameter (D) of a rolled material is incorporated in the above equation (Ib) as a factor for determining the composition of a spring steel is that the diameter of the rolled material exerts a large effect on the cooling rate upon hot rolling, that is, the metal structure of the rolled material. The present inventors found that when the composition of the spring steel is controlled such that the value of (FP/log D) specified in the equation (Ib) is in the range from 2.0 to 4.0, the performances of the obtained bar/wire can be further stabilized.

From the viewpoint of the strength and metal structure of the rolled material, the spring steel for spring of the present invention is specified such that the tensile strength is 1350 MPa or less; 90% or more, preferably, 95% or more of the cross-section of the structure of the rolled material is a ferrite/pearlite structure or pearlite structure; and the nodule size number of the pearlite is 6 or more. For the rolled material having the structure other than the above, for example, a supercooling structure such as martensite and bainite, the strength of the rolled material is excessively increased. Accordingly, the rolled material is difficult to be subjected to cold working as it is and essentially requires the softening heat treatment as an intermediate step.

For the rolled material having the pearlite nodule size number of less than 6, it is reduced in the ductility, and is difficult to obtain a good cold workability, which fails to achieve the object of the present invention.

In addition, to enhance the characteristics of a bar/wire and to obtain the desirable metal structure, it is very effective to use a spring steel satisfying the requirements regarding the composition including the relationship specified in the equations (Ia) and (Ib), and to suitably control the hot rolling condition. The hot rolling condition may be specified such that the starting temperature of hot rolling is set at 850°–1050° C., preferably, at 900°14 1050° C., the cooling starting temperature after rolling is set at 700°–900° C., preferably, at 750°–850° C., and the average cooling rate from the cooling starting temperature to 500° C. is set at 0.5°–3.0° C./sec.

When the starting temperature of hot rolling is less than 850° C., the deforming resistance upon hot rolling becomes larger, to generate the surface defects such as wrinkling on the surface of the rolled material, thus deteriorating the fatigue characteristic of a spring as the final product. On the contrary, when it is more than 1050° C., the surface decarbonization upon hot rolling is significantly generated, to excessively increase the decarbonization of the surface of the rolled material, thus deteriorating the fatigue characteristic.

In this specification, the cooling starting temperature means the temperature at which a steel wire cooled with water after hot rolling is wound in a loop and is started to be cooled; or it means the temperature at which a steel bar cooled with water after hot rolling is placed on a cooling bed and is started to be cooled. The reason why the above cooling starting temperature after hot rolling is specified is to prevent the emergence of a supercooling structure on the surface of the rolled material and to suppress an increase in the hardenability due to the coarsening of crystal grains. When the cooling starting temperature is less than 700° C., the cooling rate after hot rolling must be increased, which causes a supercooling structure on the surface or requires low temperature rolling, thus tending to generate surface defects such as wrinkling on the rolled material.

When the cooling starting temperature is more than 900° C., austenite crystal grains are coarsened and thereby the hardenability is increased, which tends to generate a supercooling structure in the subsequent cooling step. When, the average cooling rate to 500° C. is less than 0.5° C./sec, ferrite decarbonization is generated on the surface of the rolled material, which exerts an adverse effect on the fatigue characteristic of a spring as the final product. On the contrary, when it is more than 3.0° C./sec, there emerges a supercooling structure having an area ratio of 10% or more in the cross-section of the rolled material, thereby deteriorating the drawability, which requires the heat treatment such as softening.

On the other hand, when the rolling starting temperature upon hot rolling, cooling starting temperature after rolling, and cooling rate to 500° C. are suitably set as described above, the excessive decarbonized layer is not formed on the surface of the rolled material, the supercooling structure is little generated, and the suitable pearlite nodule size can be obtained. As a result, it becomes possible to perform the cold working after hot rolling without any heat treatment such as softening, and to obtain the rolled material for spring which is excellent in corrosion fatigue characteristic without any surface defect.

According to the present invention, by specifying the chemical composition of a spring steel and satisfying the requirement in the above equation (Ia); satisfying the requirement in the above equation (Ib) when the spring steel is a bar/wire; and suitably setting the hot rolling condition and the subsequent cooling condition to obtain the suitable metal structure with less supercooling structure and nodule size, it becomes possible to smoothly perform the cold working without any softening heat treatment such as annealing, and to obtain a spring steel for spring having a high strength and high corrosion resistance by the subsequent quenching and tempering, or to obtain a spring steel for spring having an excellent performance as it is.

The present invention will be described in details by way of examples. However, such examples are for illustrative purposes only, and it is to be understood that all changes and modifications may be made without departing from the technical scope of the present invention.

EXAMPLE 1

Test Steel Nos. 1 to 55 shown in Tables 1 and 2 and existing steels having compositions specified in JIS-SUP7 were melted. Each steel was forged in a square billet of 155 mm×155 mm, and was then hot-rolled into a wire having a diameter of 14 mm or 30 mm. In addition, for each of Test Steel Nos. 11 to 15, a wire having a diameter of 8 mm was prepared. Each rolled material was subjected to tensile strength test for examining the material characteristics as the rolled material. On the other hand, each rolled material having a diameter of 8, 14 or 30 mm was drawn into a diameter of 7.2, 12.5 or 27 mm without any softening heat treatment, thus examining the drawability. In addition, the hot rolling condition was set such that the starting temperature of hot rolling was 950° C., the cooling starting temperature after hot rolling was 775° C., and the average cooling rate from the cooling starting temperature to 500° C. was 1.0° C./sec.

To evaluate the performance as a spring, the wire having a diameter of 12.5 mm or 27 mm was cut-out, being subjected to quenching and tempering, and was machined into a tensile test specimen having diameters of 11 mm×400 mm at parallel portions. The quenching and tempering were performed as follows: namely, the wire was kept at 925° C.×10 min and then oil-quenched, and was tempered for 1 hr at 400° C.

To evaluate the corrosion resistance, the wire having a diameter of 12.5 mm or 27 mm was cut-out, being subjected to quenching and tempering in the same condition as in the tensile test specimen, and was machined into a test specimen having a size of 11 mm×60 mm, which was subjected to the following corrosion test. After the corrosion test, the depth of the corrosion pit was measured, which gave the results shown in Tables 3 and 4.

(Evaluation of Corrosion Resistance)

corrosion condition:

repeating the step of [salt spray for 8 hr→ leaving for 16 hr (35° C., 60% RH)] by seven cycles depth of corrosion pit:

the maximum depth of a corrosion pit in the test specimen is estimated by an extreme value analyzing method

TABLE 1

| | | Chemical composition (mass %) | | | | | | | | | | | | | | | | FP |
|---|---|---|---|---|---|---|---|---|---|---|---|---|---|---|---|---|---|---|
| Kind of steel | No. | C | Si | Mn | Cu | Ni | Cr | Mo | V | Nb | Al | Ti | Co | W | Ca | La | Ce | value |
| Inventive steel | 1 | 0.38 | 2.46 | 0.33 | — | 0.48 | 0.98 | — | 0 | — | — | — | — | — | — | — | — | 4.14 |
| Inventive steel | 2 | 0.51 | 1.99 | 0.30 | — | 0.31 | 0.75 | 0.1 | 0 | — | — | — | — | — | — | — | — | 4.13 |
| Inventive steel | 3 | 0.40 | 2.19 | 0.22 | 0.20 | 0.32 | 1.48 | — | 0 | — | — | — | — | — | — | — | — | 4.13 |
| Inventive steel | 4 | 0.41 | 2.25 | 0.32 | 0.21 | 0.82 | 0.89 | — | 0.18 | — | — | — | — | — | — | — | — | 4.17 |
| Inventive steel | 5 | 0.42 | 2.22 | 0.28 | 0.21 | 0.33 | 1.02 | — | 0.18 | — | — | — | — | — | — | — | — | 3.65 |
| Inventive steel | 6 | 0.49 | 1.61 | 0.21 | 0.20 | 0.31 | 1.01 | — | 0.20 | — | — | — | — | — | — | — | — | 2.84 |
| Inventive steel | 7 | 0.41 | 2.49 | 0.42 | 0.20 | 0.31 | 0.80 | — | 0.19 | — | 0.5 | — | — | — | — | — | — | 4.08 |
| Inventive steel | 8 | 0.40 | 2.22 | 0.31 | 0.20 | — | 0.68 | 0.2 | 0.20 | — | — | — | — | — | — | — | — | 4.08 |
| Inventive steel | 9 | 0.50 | 1.58 | 0.32 | 0.20 | 0.35 | 1.23 | — | 0.20 | — | — | — | 1.5 | — | — | — | — | 4.06 |
| Inventive steel | 10 | 0.51 | 1.59 | 0.29 | — | 0.38 | 1.22 | — | 0.20 | — | — | — | — | 0.25 | — | — | — | 3.93 |
| Inventive steel | 11 | 0.51 | 2.00 | 0.19 | — | 0.28 | 0.79 | — | 0.15 | — | — | — | — | — | — | — | — | 2.64 |
| Inventive steel | 12 | 0.49 | 1.61 | 0.20 | — | 0.28 | 0.98 | — | 0.15 | — | — | — | — | — | — | — | — | 2.75 |
| Inventive steel | 13 | 0.51 | 1.97 | 0.30 | 0.20 | 0.28 | 0.78 | — | 0.16 | — | — | — | — | — | — | — | — | 3.20 |
| Inventive steel | 14 | 0.56 | 1.60 | 0.32 | 0.20 | 0.28 | 0.78 | — | 0.20 | 0.031 | — | — | — | — | — | — | — | 3.11 |
| Inventive steel | 15 | 0.55 | 1.61 | 0.35 | 0.20 | 0.28 | 0.75 | — | 0.20 | — | — | 0.03 | — | — | — | — | — | 3.16 |
| Inventive steel | 16 | 0.51 | 1.61 | 0.31 | — | 0.21 | 1.38 | — | 0.20 | — | — | — | — | — | — | — | — | 4.22 |
| Inventive steel | 17 | 0.50 | 2.01 | 0.31 | 0.20 | 0.84 | 0.85 | — | 0.20 | — | — | — | — | — | — | — | — | 4.14 |
| Inventive steel | 18 | 0.48 | 2.01 | 0.31 | — | 0.28 | 0.79 | — | 0.15 | — | — | — | — | — | 0.005 | — | — | 3.21 |
| Inventive steel | 19 | 0.49 | 2.00 | 0.33 | — | 0.31 | 0.75 | — | 0.16 | — | — | — | — | — | — | 0.05 | — | 3.28 |
| Inventive steel | 20 | 0.49 | 2.03 | 0.31 | — | 0.30 | 0.82 | — | 0.18 | — | — | — | — | — | — | — | 0.05 | 3.37 |
| Inventive steel | 21 | 0.41 | 2.21 | 0.21 | 0.20 | 0.32 | 1.43 | — | 0.19 | — | — | — | — | — | — | 0.04 | — | 4.02 |
| Inventive steel | 22 | 0.40 | 2.22 | 0.31 | 0.20 | — | 0.79 | 0.2 | 0.20 | — | — | — | — | — | — | 0.05 | — | 4.48 |
| Inventive steel | 23 | 0.55 | 1.61 | 0.34 | 0.20 | 0.31 | 0.80 | — | 0.20 | 0.031 | — | — | — | — | 0.005 | — | — | 3.27 |
| Inventive steel | 24 | 0.48 | 1.60 | 0.31 | — | 0.31 | 1.01 | — | 0.20 | — | — | — | — | — | — | — | 0.05 | 3.37 |
| Inventive steel | 25 | 0.47 | 1.99 | 0.30 | — | 0.83 | 0.86 | — | 0.19 | — | — | — | — | — | 0.005 | — | — | 3.93 |
| Inventive steel | 26 | 0.48 | 1.60 | 0.30 | — | 0.39 | 0.98 | — | 0.15 | — | — | — | — | — | — | — | — | 3.34 |
| Inventive steel | 27 | 0.48 | 1.61 | 0.31 | — | 0.41 | 1.28 | — | 0.20 | — | — | — | — | — | — | — | — | 4.14 |
| Inventive steel | 28 | 0.55 | 1.61 | 0.21 | 0.20 | — | 0.79 | 0.2 | 0.15 | — | — | — | — | — | — | — | — | 3.66 |
| Inventive steel | 29 | 0.56 | 1.60 | 0.35 | 0.21 | 0.39 | 0.78 | — | 0.20 | 0.031 | 0.5 | — | — | — | — | — | — | 3.39 |
| Inventive steel | 30 | 0.41 | 2.49 | 0.42 | 0.21 | 0.31 | 0.80 | — | 0.19 | — | — | — | — | — | — | — | — | 4.08 |

TABLE 2

| | | Chemical composition (mass %) | | | | | | | | | | | | | | | | FP |
|---|---|---|---|---|---|---|---|---|---|---|---|---|---|---|---|---|---|---|
| Kind of steel | No. | C | Si | Mn | Cu | Ni | Cr | Mo | V | Nb | Al | Ti | Co | W | Ca | La | Ce | value |
| Comparative steel | 31 | 0.25 | 1.98 | 0.30 | 0.19 | 0.31 | 0.82 | — | 0.19 | — | — | — | — | — | — | — | — | 2.43 |
| Comparative steel | 32 | 0.80 | 2.02 | 0.32 | 0.21 | 0.30 | 0.81 | — | 0.21 | — | — | — | — | — | — | — | — | 4.53 |
| Comparative steel | 33 | 0.52 | 0.70 | 0.32 | 0.20 | 0.31 | 0.79 | — | 0.20 | — | — | — | — | — | — | — | — | 2.13 |
| Comparative steel | 34 | 0.49 | 3.42 | 0.31 | 0.19 | 0.33 | 0.78 | — | 0.18 | — | — | — | — | — | — | — | — | 4.63 |
| Comparative steel | 35 | 0.50 | 2.03 | 0.08 | 0.21 | 0.32 | 0.83 | — | 0.21 | — | — | — | — | — | — | — | — | 2.12 |
| Comparative steel | 36 | 0.51 | 2.02 | 0.98 | 0.19 | 0.31 | 0.80 | — | 0.20 | — | — | — | — | — | — | — | — | 7.21 |
| Comparative steel | 37 | 0.50 | 2.02 | 0.33 | — | — | 0.96 | — | 0.21 | — | — | — | — | — | — | — | — | 3.48 |
| Comparative steel | 38 | 0.52 | 1.99 | 0.30 | 0.21 | 1.49 | 0.82 | — | 0.20 | — | — | — | — | — | — | — | — | 4.82 |
| Comparative steel | 39 | 0.51 | 2.01 | 0.31 | 0.22 | 0.31 | — | — | 0.20 | — | — | — | — | — | — | — | — | 1.23 |
| Comparative steel | 40 | 0.49 | 2.02 | 0.30 | 0.20 | 0.30 | 1.70 | — | 0.20 | — | — | — | — | — | — | — | — | 5.69 |
| Comparative steel | 41 | 0.38 | 2.46 | 0.43 | — | 0.48 | 0.98 | — | 0.20 | — | — | — | — | — | — | — | — | 4.81 |
| Comparative steel | 42 | 0.54 | 2.01 | 0.42 | 0.19 | 0.31 | 1.45 | — | 0.20 | — | — | — | — | — | — | — | — | 6.28 |
| Comparative steel | 43 | 0.51 | 2.25 | 0.33 | 0.20 | 0.82 | 1.20 | — | 0.15 | — | — | — | — | — | — | — | — | 5.83 |
| Comparative steel | 44 | 0.51 | 1.99 | 0.33 | 0.20 | 0.52 | 1.21 | — | 0.15 | — | — | — | — | — | — | — | — | 4.96 |
| Comparative steel | 45 | 0.41 | 2.45 | 0.41 | 0.20 | 0.31 | 1.21 | — | 0.20 | — | — | — | — | — | — | — | — | 5.29 |
| Comparative steel | 46 | 0.51 | 1.61 | 0.41 | 0.20 | 0.82 | 0.98 | — | 0.20 | — | — | — | — | — | — | — | — | 4.72 |
| Comparative steel | 47 | 0.55 | 1.61 | 0.41 | 0.20 | 0.83 | 1.02 | — | 0.19 | — | — | — | — | — | — | — | — | 5.07 |
| Comparative steel | 48 | 0.51 | 2.00 | 0.32 | — | 0.31 | 0.75 | 0.6 | 0.20 | — | — | — | — | — | — | — | — | 9.22 |
| Comparative steel | 49 | 0.42 | 1.61 | 0.20 | — | 0.21 | 0.62 | — | 0.20 | — | — | — | — | — | — | — | — | 1.82 |

TABLE 2-continued

| Kind of steel | No. | Chemical composition (mass %) C | Si | Mn | Cu | Ni | Cr | Mo | V | Nb | Al | Ti | Co | W | Ca | La | Ce | FP value |
|---|---|---|---|---|---|---|---|---|---|---|---|---|---|---|---|---|---|---|
| Reference steel | 50 | 0.51 | 1.99 | 0.30 | — | 0.31 | 0.75 | — | 0.18 | — | — | — | — | — | — | — | — | 3.29 |
| Reference steel | 51 | 0.40 | 2.19 | 0.22 | 0.20 | 0.32 | 1.48 | — | 0.19 | — | — | — | — | — | — | — | — | 4.13 |
| Reference steel | 52 | 0.40 | 2.22 | 0.31 | 0.20 | — | 0.68 | 0.2 | 0.20 | — | — | — | — | — | — | — | — | 4.08 |
| Reference steel | 53 | 0.56 | 1.60 | 0.32 | 0.20 | 0.28 | 0.78 | — | 0.20 | 0.031 | — | — | — | — | — | — | — | 3.11 |
| Reference steel | 54 | 0.51 | 1.61 | 0.31 | — | 0.21 | 1.38 | — | 0.20 | — | — | — | — | — | — | — | — | 4.22 |
| Reference steel | 55 | 0.50 | 2.01 | 0.31 | 0.20 | 0.84 | 0.85 | — | 0.20 | — | — | — | — | — | — | — | — | 4.14 |
| Comparative steel | SUP7 | 0.61 | 2.02 | 0.89 | — | — | — | — | — | — | — | — | — | — | — | — | — | 2.38 |

TABLE 3

| Kind of steel | No. | Rolled material: Wire diameter D (mm) | FP/logD | Strength (MPa) | Quenched and tempered material: Tensile strength (MPa) | Depth of corrosion pit (μm) |
|---|---|---|---|---|---|---|
| Inventive steel | 1 | 14 | 3.61 | 1260 | 1902 | 86 |
| Inventive steel | 2 | 14 | 3.60 | 1270 | 2023 | 88 |
| Inventive steel | 3 | 14 | 3.61 | 1220 | 1945 | 66 |
| Inventive steel | 4 | 14 | 3.64 | 1250 | 1925 | 69 |
| Inventive steel | 5 | 14 | 3.19 | 1110 | 1947 | 74 |
| Inventive steel | 6 | 14 | 2.48 | 1090 | 1961 | 87 |
| Inventive steel | 7 | 14 | 3.56 | 1180 | 1957 | 78 |
| Inventive steel | 8 | 14 | 3.56 | 1260 | 1907 | 81 |
| Inventive steel | 9 | 14 | 3.54 | 1290 | 2010 | 76 |
| Inventive steel | 10 | 14 | 3.43 | 1280 | 2007 | 89 |
| Inventive steel | 11 | 8 | 2.93 | 1130 | — | — |
| Inventive steel | 11 | 14 | 2.31 | 1010 | 2032 | 88 |
| Inventive steel | 12 | 8 | 3.05 | 1160 | — | — |
| Inventive steel | 12 | 14 | 2.40 | 1010 | 1937 | 90 |
| Inventive steel | 13 | 8 | 3.54 | 1070 | — | — |
| Inventive steel | 13 | 14 | 2.79 | 1005 | 2030 | 89 |
| Inventive steel | 14 | 8 | 3.44 | 1210 | — | — |
| Inventive steel | 14 | 14 | 2.71 | 1150 | 2052 | 95 |
| Inventive steel | 15 | 8 | 3.50 | 1230 | — | — |
| Inventive steel | 15 | 14 | 2.76 | 1150 | 2035 | 97 |
| Inventive steel | 16 | 30 | 2.85 | 1180 | 2001 | 94 |
| Inventive steel | 17 | 30 | 2.80 | 1160 | 2028 | 86 |
| Inventive steel | 18 | 14 | 2.80 | 1175 | 1971 | 80 |
| Inventive steel | 19 | 14 | 2.86 | 1150 | 1982 | 77 |
| Inventive steel | 20 | 14 | 2.94 | 1190 | 1992 | 75 |
| Inventive steel | 21 | 14 | 3.50 | 1220 | 1957 | 60 |
| Inventive steel | 22 | 14 | 3.91 | 1280 | 1918 | 73 |
| Inventive steel | 23 | 14 | 2.85 | 1120 | 2042 | 87 |
| Inventive steel | 24 | 30 | 2.28 | 1110 | 1924 | 82 |
| Inventive steel | 25 | 30 | 2.66 | 1140 | 1958 | 78 |
| Inventive steel | 26 | 14 | 2.91 | 1120 | 1917 | 82 |
| Inventive steel | 27 | 14 | 3.61 | 1280 | 1993 | 79 |
| Inventive steel | 28 | 14 | 3.19 | 1250 | 2053 | 97 |
| Inventive steel | 29 | 14 | 2.96 | 1110 | 2052 | 89 |
| Inventive steel | 30 | 14 | 3.56 | 1160 | 1957 | 78 |

TABLE 4

| Kind of steel | No. | Rolled material: Wire diameter D (mm) | FP/logD | Strength (MPa) | Quenched and tempered material: Tensile strength (MPa) | Depth of corrosion pit (μm) |
|---|---|---|---|---|---|---|
| Comparative steel | 31 | 14 | 2.12 | — | 1619 | — |
| Comparative steel | 32 | 14 | 3.95 | — | 2512 | 152 |
| Comparative steel | 33 | 14 | 1.86 | — | 1840 | — |

TABLE 4-continued

| Kind of steel | No. | Rolled material: Wire diameter D (mm) | FP/logD | Strength (MPa) | Quenched and tempered material: Tensile strength (MPa) | Depth of corrosion pit (μm) |
|---|---|---|---|---|---|---|
| Comparative steel | 34 | 14 | 4.04 | 1480 | 2238 | — |
| Comparative steel | 35 | 14 | 1.85 | — | 1820 | — |
| Comparative steel | 36 | 14 | 6.29 | 1790 | 2027 | — |
| Comparative steel | 37 | 14 | 3.04 | 1190 | 2023 | 119 |
| Comparative steel | 38 | 14 | 4.21 | 1460 | 2054 | 78 |
| Comparative steel | 39 | 14 | 1.07 | — | 1985 | 115 |
| Comparative steel | 40 | 14 | 4.88 | 1640 | 2077 | — |
| Comparative steel | 41 | 14 | 4.19 | 1390 | 1900 | — |
| Comparative steel | 42 | 14 | 5.48 | 1630 | 2134 | — |
| Comparative steel | 43 | 14 | 5.09 | 1600 | 2104 | — |
| Comparative steel | 44 | 14 | 4.33 | 1490 | 2062 | — |
| Comparative steel | 45 | 14 | 4.61 | 1450 | 1981 | — |
| Comparative steel | 46 | 14 | 4.12 | 1390 | 1985 | — |
| Comparative steel | 47 | 14 | 4.42 | 1510 | 2051 | — |
| Comparative steel | 48 | 14 | 8.05 | — | 2066 | — |
| Comparative steel | 49 | 14 | 1.59 | — | 1803 | — |
| Reference steel | 50 | 14 | 3.60 | 1270 | 2023 | 88 |
| Reference steel | 51 | 14 | 3.61 | 1220 | 1945 | 66 |
| Reference steel | 52 | 14 | 3.56 | 1260 | 1907 | 81 |
| Reference steel | 53 | 14 | 2.71 | 1190 | — | — |
| Reference steel | 53 | 14 | 2.71 | 1160 | 2052 | 95 |
| Reference steel | 54 | 30 | 2.85 | 1180 | 2001 | 94 |
| Reference steel | 55 | 30 | 2.80 | 1160 | 2028 | 86 |
| Comparative steel | SUP7 | 14 | 2.08 | 1070 | 2087 | 135 |

From Tables 1 to 4, the following will be apparent.

Test Steel Nos. 1 to 30 are inventive examples satisfying the requirements of the present invention, either of which exhibits no supercooling structure after hot rolling, and has a strength of 1350 MPa or less and an excellent drawability; and further has a strength after quenching and tempering being 1900 MPa or more and a corrosion resistance superior to that of the conventional material (JIS-SUP7).

On the contrary, Test Steel Nos. 31 to 49 are comparative examples being lack of either of the requirements of composition, (FP) value and (FP/log D) value, each of which exhibits an inconvenience in either of the performances, as described later.

In Test Steel No. 31, the C content is lacking, and thereby the strength after quenching and tempering is insufficient. On the contrary, in Test Steel No. 32, the C content is excessively large, and thereby the strength is increased but the corrosion resistance is significantly reduced.

In Test Steel No. 33, the Si content is lacking and the (FP) value and the (FP/log D) value are low, so that the strength after quenching and tempering is low. On the contrary, in Test Steel No. 34, the Si content, the (FP) value and the (FP/log D) value respectively exceed the specified ranges, so that a supercooling structure emerges in the rolled material and the strength is excessively increased thereby deteriorating the drawability. In Test Steel No. 35, the Mn content is lacking and the (FP) value and the (FP/log D) value are low, and thereby the strength after quenching and tempering is low. On the other hand, In Test Steel No. 36, the Mn content, the (FP) value and the (FP/log D) value respectively exceed the specified ranges, a supercooling structure emerges in the rolled material, and the strength of the rolled material is excessively increased thereby deteriorating the drawability.

In Test Steel No. 37, since two elements of Ni and Mo are not contained, the corrosion resistance is low. In Test Steel No. 38, the Ni content, the (FP) value and the (FP/log D) value respectively exceed the specified ranges, so that the strength of the rolled material is excessively increased thereby deteriorating the drawability. In Test Steel No. 39, since Cr is not contained, the corrosion resistance is insufficient. In Test Steel Nos. 40 to 48, the (FP) value and the (FP/log D) value are excessively increased, and thereby a supercooling structure emerges in the rolled material and the strength of the rolled material is excessively increased thereby deteriorating the drawability. In Test Steel No. 49, since the (FP) value and the (FP/log D) value are low, the strength after quenching and tempering cannot reach the target value.

Test Steel Nos. 50 to 55 are similar to Test Steel Nos. 18 to 25, except that Ca, La and Ce are not contained, and which are poor in corrosion resistance compared with Test Steel Nos. 18 to 25.

Figure 2:
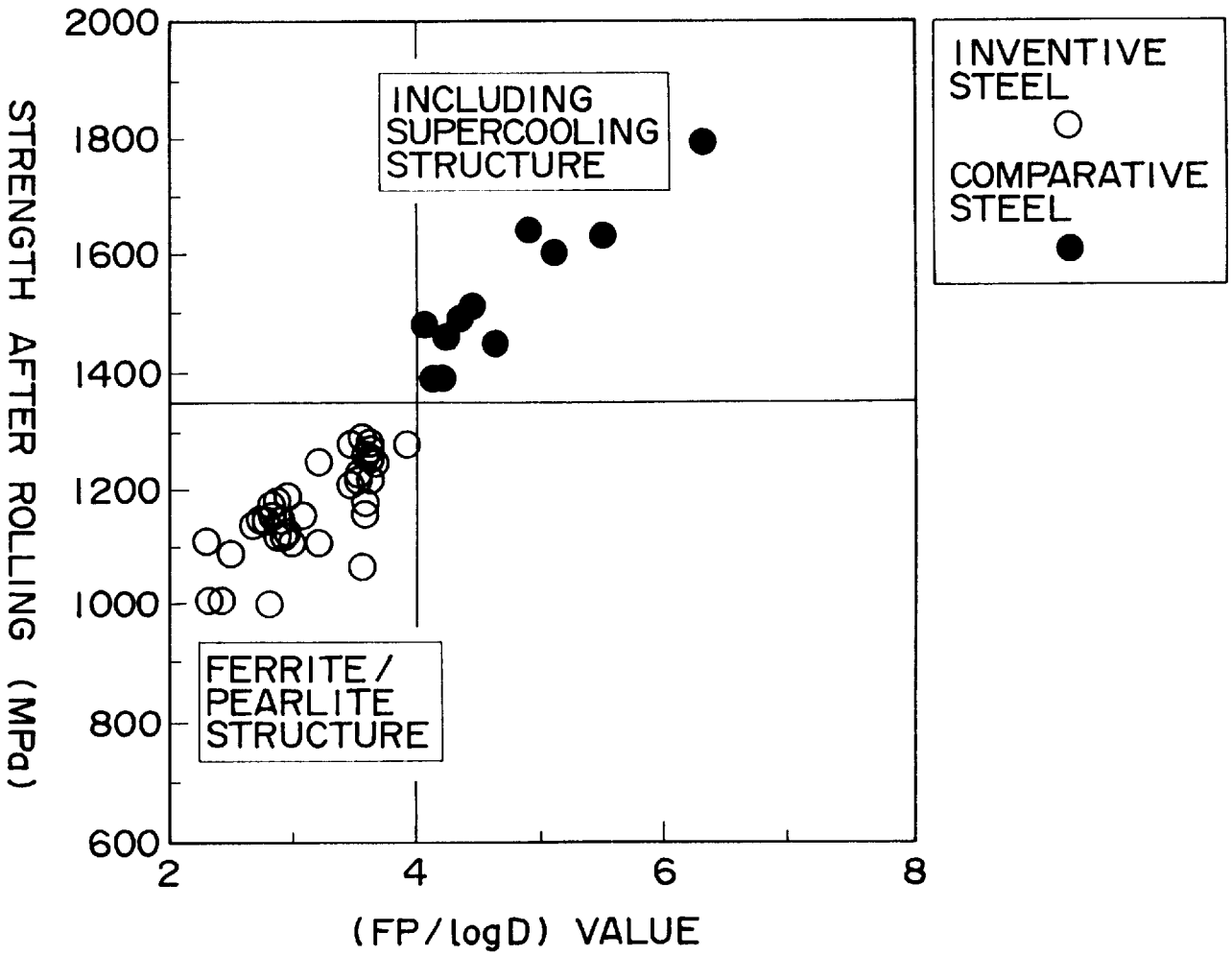
FIG. 2 is a graph showing the relationship between the (FP/log D) value and the strength after rolling with respect to a steel bar/wire.

FIGS. 1 and 2 are graphs showing the relationship between the (FP) value and the (FP/log D) value and the strength after rolling with respect to each spring steel shown in Tables 1 to 4. As is apparent from these figures, in the spring steel having the (FP) value ranging from 2.5 to 4.5 and the (FP/log D) value ranging from 2.0 to 4.0, the strength after rolling is suppressed in the strength level enabling cold working without softening heat treatment, that is, 1350 MPa or less.

Figure 3:
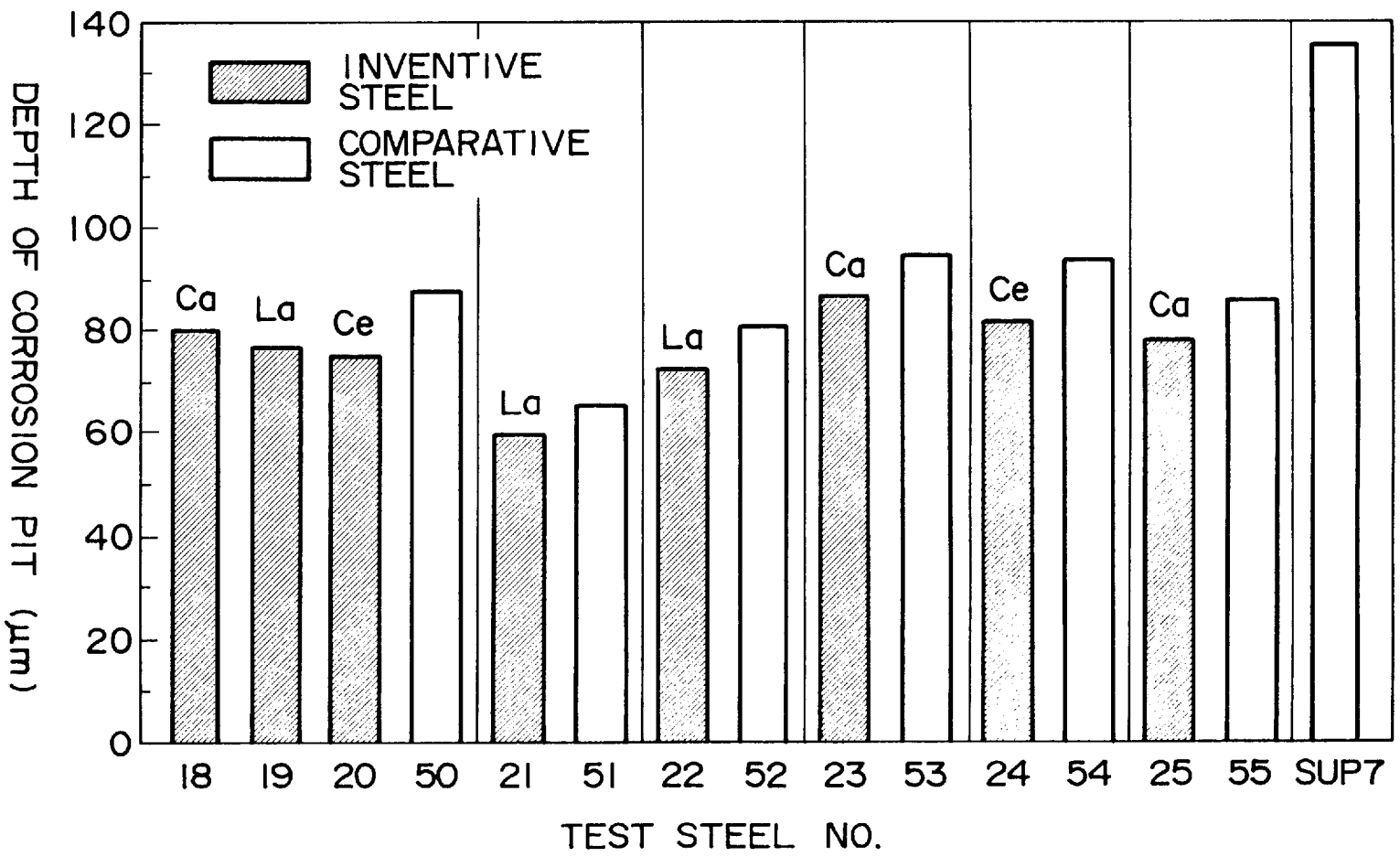
FIG. 3 is a graph showing corrosion pits of a Ca containing steel, La containing steel, Ce containing steel, in comparison with those of steels not containing any of these elements.

FIG. 3 is a view showing the depths of the corrosion pits of a Ca containing steel, La containing steel and Ce containing steel, in comparison with those of steels not containing any of these elements. As is apparent from FIG. 3, the addition of Ca, La and Ce is effective to enhance the corrosion resistance.

EXAMPLE 2

Figure 4:
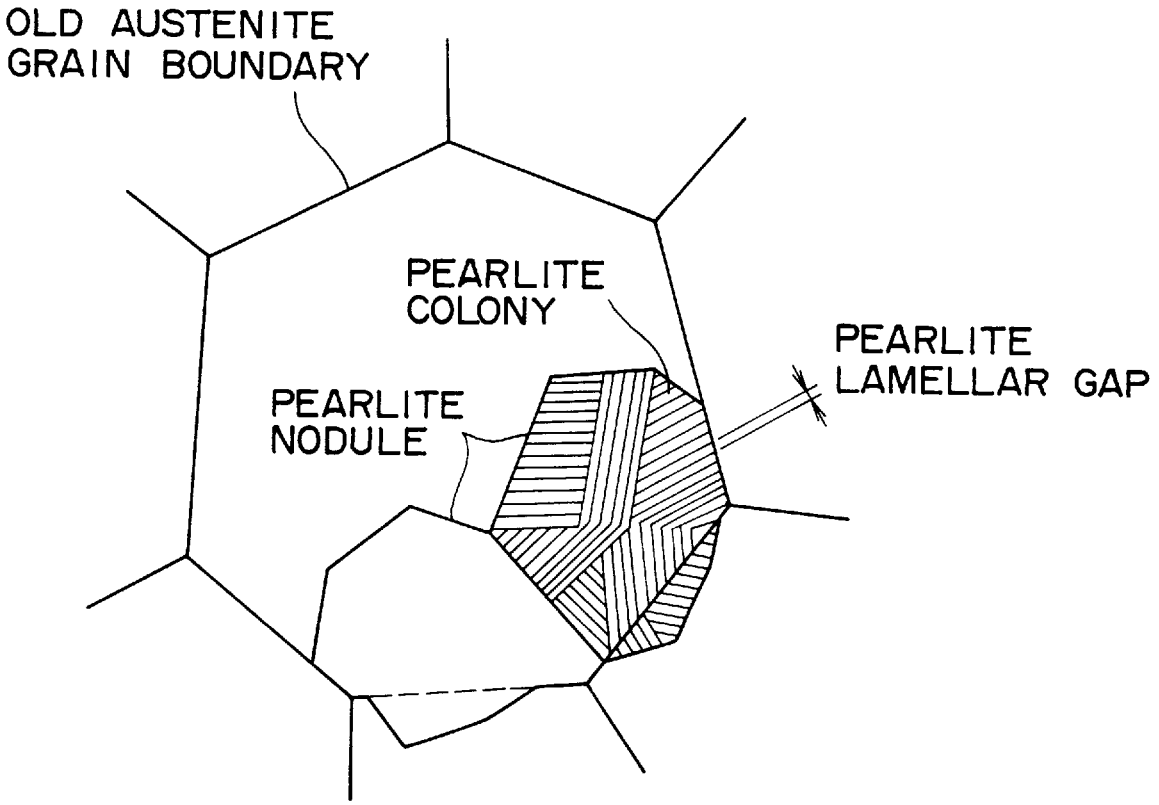
FIG. 4 is a typical view showing the factor of the pearlite structure of a rolled material.

As shown in Tables 5 and 7, the typical test steels shown in Example 1 were further tested by changing the heating starting temperature upon hot rolling, cooling starting temperature after rolling, and cooling rate. To examine the material characteristics, the rolled material (14 mm) thus obtained was subjected to tensile strength test, microscopic observation of cross-section, surface decarbonization, and observation for surface defects. In addition, the pearlite nodule size was measured, with the structure shown in FIG. 4 being taken as an unit, by a method wherein a test specimen was etched in cross-section with 2% alcohol nitrate and observed using an optical microscope and was then measured in accordance with the austenitic crystal grain particle measurement method specified in JIS G 0551. The area ratio of a supercooling structure in the whole structure was measured in a method wherein the supercooling structure was observed at the surface layer portion, ¼ D portion, and ½ D portion (D: diameter of the rolled material) using an optical microscope at a free magnification, and further measured using an image analyzer. Moreover, each rolled material was drawn to a diameter of 12.5 mm without any softening heat treatment, and was examined for the presence or absence of breakage and bending. The sample was further quenched and tempered, and was examined for the strength after quenching and tempering. The results are shown in Tables 6 and 8.

From Tables 6 to 8, the following will be apparent.

Tables 5 and 6 show the experimental results for examining the influence of the cooling rate after hot rolling. In the comparative example in which the (average) cooling rate is less than 0.5° C./sec, the metal structure and the nodule size are good but the ferrite decarbonization is generated. On the other hand, in the comparative example in which the cooling rate is more than 3.0° C./sec, the bainite is produced in the metal structure and the area ratio of (ferrite+martensite) does not satisfy the desirable requirement, so that the strength is excessively increased thereby deteriorating the drawability. On the contrary, in the inventive example in which the cooling rate is within the suitable range from 0.5° to 3.0° C./sec, the surface decarbonization is not generated and the metal structure and the nodule size are suitable, so that the strength is suppressed to be 1350 MPa or less, thus ensuring the excellent drawability.

TABLE 5

| | | | Rolling condition | | | |
|---|---|---|---|---|---|---|
| No. | Kind of steel No. | FP/logD value | Starting temperature of hot rolling (°C.) | Starting temperature of cold rolling (°C.) | Cooling rate (° C./sec) | Remark |
| 26A | 26 | 2.91 | 950 | 775 | 0.3 | Comparative example |
| B | | | | | 1.0 | Inventive example |
| C | | | | | 2.0 | Inventive example |
| D | | | | | 3.5 | Comparative example |
| 27A | 27 | 3.61 | 950 | 775 | 0.3 | Comparative example |
| B | | | | | 1.0 | Inventive example |
| C | | | | | 2.0 | Inventive example |
| D | | | | | 3.5 | Comparative example |
| 28A | 28 | 3.19 | 950 | 775 | 0.3 | Comparative example |
| B | | | | | 1.0 | Inventive example |
| C | | | | | 2.0 | Inventive example |
| D | | | | | 3.5 | Comparative example |
| 29A | 29 | 2.96 | 950 | 775 | 0.3 | Comparative example |
| B | | | | | 1.0 | Inventive example |
| C | | | | | 2.0 | Inventive example |
| D | | | | | 3.5 | Comparative example |
| 30A | 30 | 3.56 | 950 | 775 | 0.3 | Comparative example |
| B | | | | | 1.0 | Inventive example |
| C | | | | | 2.0 | Inventive example |
| D | | | | | 3.5 | Comparative example |
| 34A | 34 | 4.04 | 950 | 775 | 1.0 | Comparative example |
| 36A | 36 | 6.29 | 950 | 775 | 1.0 | Comparative example |
| 38A | 38 | 4.21 | 950 | 775 | 1.0 | Comparative example |
| 40A | 40 | 4.88 | 950 | 775 | 1.0 | Comparative example |
| 42A | 42 | 5.48 | 950 | 775 | 1.0 | Comparative example |
| 48A | 48 | 8.04 | 950 | 775 | 1.0 | Comparative example |
| SUP7 | SUP7 | 2.38 | 950 | 775 | 1.0 | Comparative example |

TABLE 6

| | Rolled material | | | | | | |
|---|---|---|---|---|---|---|---|
| | | Structure | | Nodule | Ferrite | | |
| No. | Strength (MPa) | Structure | Ratio of (F + P) | size number | decarboni-zation | Draw-ability | Remark |
| 26A | 1040 | F + P | 100 | 7.0 | Presence | Good | Comparative example |
| B | 1120 | F + P | 100 | 7.5 | Absence | Good | Inventive example |
| C | 1210 | F + P | 100 | 7.8 | Absence | Good | Inventive example |
| D | 1470 | F + P + B | 55 | 7.7 | Absence | Poor | Comparative example |
| 27A | 1100 | F + P | 100 | 7.3 | Presence | Good | Comparative example |
| B | 1280 | F + P | 100 | 7.5 | Absence | Good | Inventive example |
| C | 1340 | P | 100 | 7.7 | Absence | Good | Inventive example |
| D | 1590 | P + B + M | 35 | 7.3 | Absence | Poor | Comparative example |
| 28A | 1130 | F + P | 100 | 7.5 | Presence | Good | Comparative example |
| B | 1250 | F + P | 100 | 7.5 | Absence | Good | Inventive example |
| C | 1320 | P | 100 | 7.6 | Absence | Good | Inventive example |
| D | 1510 | P + B + M | 40 | — | Absence | Poor | Comparative example |
| 29A | 1050 | F + P | 100 | 8.2 | Presence | Good | Comparative example |
| B | 1110 | F + P | 100 | 8.5 | Absence | Good | Inventive example |
| C | 1210 | F + P | 100 | 8.6 | Absence | Good | Inventive example |
| D | 1400 | F + P + B | 80 | — | Absence | Poor | Comparative example |
| 30A | 1080 | F + P | 100 | 9.1 | Presence | Good | Comparative example |
| B | 1160 | F + P | 100 | 8.9 | Absence | Good | Inventive example |
| C | 1190 | F + P | 100 | 8.9 | Absence | Good | Inventive example |
| D | 1390 | F + P + B | 85 | — | Absence | Poor | Comparative example |
| 34A | 1480 | P + B | 60 | — | Presence | — | Comparative example |
| 36A | 1790 | P + B | 10 | — | Absence | — | Comparative example |
| 38A | 1460 | P + B | 55 | — | Absence | — | Comparative example |
| 40A | 1640 | P + B | 20 | — | Absence | — | Comparative example |
| 42A | 1630 | P + B | 25 | — | Absence | — | Comparative example |
| 48A | — | M | 0 | — | Absence | — | Comparative example |
| SUP7 | 1070 | F + P | 100 | — | Presence | Good | Comparative example |

*structure F: ferrite, P: pearlite, B: bainite, M: martensite
*ferrite decarbonization
presence: observed, absence: not observed
*drawability
good: absence of breakage and bending
poor: presence of breakage and bending

TABLE 7

| | | | Rolling condition | | | |
|---|---|---|---|---|---|---|
| No. | Kind of steel No. | FP/ logD value | Starting temper-ature of hot rolling (°C.) | Starting temper-ature of cold rolling (°C.) | Cooling rate (°C./ sec) | Remark |
| 26a | 26 | 2.91 | 750 | 650 | 1.0 | Comparative example |
| b | | | 800 | 700 | 1.0 | Comparative example |
| c | | | 875 | 750 | 1.0 | Inventive example |
| d | | | 950 | 775 | 1.0 | Inventive example |
| e | | | 1000 | 820 | 1.0 | Inventive example |
| f | | | 1100 | 920 | 1.0 | Comparative example |
| 27a | 27 | 3.61 | 800 | 700 | 1.0 | Comparative example |
| b | | | 875 | 750 | 1.0 | Inventive example |
| c | | | 950 | 775 | 1.0 | Inventive example |
| d | | | 1000 | 820 | 1.0 | Inventive example |
| e | | | 1100 | 870 | 1.0 | Comparative example |
| 28a | 28 | 3.19 | 875 | 650 | 1.0 | Comparative example |

TABLE 7-continued

| | | | Rolling condition | | | |
|---|---|---|---|---|---|---|
| No. | Kind of steel No. | FP/ logD value | Starting temper-ature of hot rolling (°C.) | Starting temper-ature of cold rolling (°C.) | Cooling rate (°C./ sec) | Remark |
| b | | | 800 | 700 | 1.0 | Comparative example |
| c | | | 875 | 750 | 1.0 | Inventive example |
| d | | | 950 | 775 | 1.0 | Inventive example |
| e | | | 1000 | 820 | 1.0 | Inventive example |
| f | | | 1100 | 910 | 1.0 | Comparative example |
| 29a | 29 | 2.96 | 800 | 700 | 1.0 | Comparative example |
| b | | | 875 | 750 | 1.0 | Inventive example |
| c | | | 950 | 775 | 1.0 | Inventive example |
| d | | | 1000 | 820 | 1.0 | Inventive example |
| e | | | 1100 | 920 | 1.0 | Comparative example |

TABLE 8

| | Rolled material | | | | | | | | |
|---|---|---|---|---|---|---|---|---|---|
| | | Structure | | Nodule | Ferrite | | | | |
| No. | Strength (MPa) | Structure | Ratio of (F + P) | size number | decarboni-zation | Decarbon-ization | Surface defect | Draw-ability | Remark |
| 26a | 970 | F + P | 100 | 10.5 | Presence | Small | X | Good | Comparative example |
| b | 1060 | F + P | 95 | 10.5 | Absence | Small | X | Good | Comparative example |
| c | 1110 | F + P | 100 | 7.8 | Absence | Small | ○ | Good | Inventive example |
| d | 1120 | F + P | 100 | 7.5 | Absence | Small | ◎ | Good | Inventive example |
| e | 1190 | F + P | 100 | 6.9 | Absence | Small | ◎ | Good | Inventive example |
| f | 1370 | F + P + B | 75 | 5.5 | Presence | Large | ◎ | Poor | Comparative example |
| 27a | 1010 | F + P | 90 | 9.2 | Absence | Small | X | Good | Comparative example |
| b | 1210 | F + P | 100 | 7.7 | Absence | Small | ○ | Good | Inventive example |
| c | 1280 | F + P | 100 | 7.5 | Absence | Small | ◎ | Good | Inventive example |
| d | 1320 | P | 100 | 6.5 | Absence | Small | ◎ | Good | Inventive example |
| e | 1460 | P + B + M | 65 | 5.2 | Presence | Large | ◎ | Poor | Comparative example |
| 28a | 1080 | F + P + M | 85 | 10.0 | Absence | Small | ○ | Poor | Comparative example |
| b | 1040 | F + P | 95 | 8.8 | Absence | Small | X | Good | Comparative example |
| c | 1190 | F + P | 100 | 7.5 | Absence | Small | ○ | Good | Inventive example |
| d | 1250 | F + P | 100 | 7.5 | Absence | Small | ◎ | Good | Inventive example |
| e | 1310 | P | 100 | 6.5 | Absence | Small | ◎ | Good | Inventive example |
| f | 1480 | P + B + M | 65 | — | Presence | Large | ◎ | Poor | Comparative example |
| 29a | 1020 | F + P | 95 | 10.7 | Absence | Small | X | Good | Comparative example |
| b | 1120 | F + P | 100 | 8.5 | Absence | Small | ○ | Good | Inventive example |
| c | 1110 | F + P | 100 | 8.5 | Absence | Small | ◎ | Good | Inventive example |
| d | 1230 | F + P | 100 | 7.2 | Absence | Small | ◎ | Good | Inventive example |
| e | 1440 | F + P + B | 75 | — | Presence | Large | ◎ | Poor | Comparative example |

*structure F: ferrite, F: pearlite, B: bainite, M: martensite
* ferrite decarbonization presence: observed, absence: not observed
* decarbonization
small . . . maximun decarbonized depth: 0.1 mm or less
large . . . maximum decarbonized depth: more than 0.1 mm
* surface defect (in cross-section)
X: four pieces or more
○: three pieces or less
◎: two pieces or less
* drawability
good: absence of breakage and bending
poor: presence of breakage and bending Test Steel Nos. 34A to 48A are comparative examples, in which the rolling condition is suitable but the composition of a steel, the (FP) value and the (FP/log D) value are respectively out of the specified requirements, are inconvenient in that bainite and martensite are produced in the metal structure and the suitable area ratio of (ferrite+martensite) cannot be obtained, so that the strength is excessively increased thereby deteriorating the drawability.

Test Steel Nos. 26 to 29 satisfying all the requirements of composition including the (FP) value and (FP/log D) value, were examined in terms of the effect of the starting temperature of hot rolling and the cooling starting temperature of the rolling condition, which gave the results shown in Tables 7 and 8. As is apparent from Tables 7 and 8, when the starting temperature of hot rolling is less than 850° C., surface defects are significantly generated. When the starting temperature of hot rolling is more than 1050° C. or the cooling starting temperature after hot rolling is more than 900° C., bainite and martensite are produced in the metal structure, so that the strength is excessively increased or the nodule size number becomes less than 6 and the ductility is lowered, thus deteriorating the drawability. On the contrary, in the inventive examples in which the starting temperature of hot rolling and the cooling starting temperature are specified in the suitable ranges, the metal structure becomes ferrite/pearlite or pearlite and has the suitable nodule size, thus obtaining the rolled material having a suitable drawability without generation of decarbonization and surface defects.

What is claimed is:

1. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%, and

Ni: 1.0% or less (excluding 0%) and/or Mo: 0.1–0.5%, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+1)×(3.5[Mn]+1)×(2.2[Cr]+1)×(0.4[Ni]+1)×(3[Mo]+1) in which [element] represents mass % of the element, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

2. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%, and

Ni: 1.0% or less (excluding 0%) and/or Mo: 0.1–0.5%, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+1)×(3.5[Mn]+1)×(2.2[Cr]+1)×(0.4[Ni]+1)×(3[Mo]+1) in which [element] represents mass % of the element, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

3. A spring steel of high strength and high corrosion resistance according to claim 1, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

4. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%, and

Cu: 0.1–1.0%, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+1)×(3.5[Mn]+1)×(2.2[Cr]+1)×(0.4[Ni]+1)×(3[Mo]+1) in which [element] represents mass % of the element, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

5. A spring steel of high strength and high corrosion resistance containing:

C: 0.3–0.49 mass 6 (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%, and

Cu: 0.1–1.0%, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+1)×(3.5[Mn]+1)×(2.2[Cr]+1)×(0.4[Ni]+1)×(3[Mo]+1) in which [element] represents mass % of the element, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

6. A spring steel of high strength and high corrosion resistance according to claim 1, which further contains 0.1–1.0% of Cu.

7. A spring steel of high strength and high corrosion resistance according to claim 4, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

8. A spring steel of high strength and high corrosion resistance according to claim 2, which further contains 0.1–1.0% of Cu.

9. A spring steel of high strength and high corrosion resistance according to claim 8, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

10. A spring steel of high strength and high corrosion resistance containing:

C: 0.3–0.49 mass % (hereinafter, referred to as %)

Si: 1.0–3.0%,

Mn: 0.1–0.5%,

Cr: 0.5–1.5%,

Ni: 1.0% or less (excluding 0) and/or Mo: 0.1–0.5%, and at least one element selected from a group consisting of 0.01–0.5% of V, 0.01–1.0% of Nb, 0.01–1.0% of Al and 0.01–1.0% of Ti, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+1)×(3.5[Mn]+1)×(2.2[Cr]+1)×(0.4[Ni]+1)×(3[Mo]+1) in which [element] represents mass % of the element, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

11. A spring steel of high strength and high corrosion resistance containing:

C: 0.3–0.49 mass 6 (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%, and at least one element selected from a group consisting of 0.01–0.5% of V, 0.01–1.0% of Nb, 0.01–1.0% of Al and 0.1–1.0% of Ti, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+1)×(3.5[Mn]+1)×(2.2[Cr]+1)×(0.4[Ni]+1)×(3[Mo]+1) in which [element] represents mass % of the element, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

12. A spring steel of high strength and high corrosion resistance according to claim 10, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

13. A spring steel of high strength and high corrosion resistance according to claim 10, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

14. A spring steel of high strength and high corrosion resistance according to claim 11, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

15. A spring steel of high strength and high corrosion according resistance according to claim 14, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

16. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%,

Cu: 0.1–1.0%, and at least one element selected from a group consisting of 0.01–0.5% of V, 0.01–1.0% of Nb, 0.01–1.0% of Al and 0.01–1.0% of Ti, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+0.1)×(3.5[MN]+1)×(2.2[Cr]+1)×(0.4[Ni]+1)×(3[Mo]+1) in which [element] represents mass % of the element.

17. A spring steel of high strength and high corrosion resistance according to claim 16, wherein the tensile strength after hot rolling is 1350 MPa or less; 90% or more of a cross-section section of the metal structure comprises a ferrite/pearlite structure or pearlite structure; and the nodule size number of said pearlite structure is 6 or more.

18. A spring steel of high strength and high corrosion resistance according to claim 16, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

19. A spring steel of high strength and high corrosion resistance according to claim 18, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

20. A spring steel of high strength and high corrosion resistance according to claim 17, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

21. A spring steel of high strength and high corrosion resistance according to claim 18, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

22. A spring steel of high strength and high corrosion resistance according to claim 21, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

23. A spring steel of high strength and high corrosion resistance containing:

C: 0.3–0.49 mass 6 (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%, and

Co: 0.1–3.0% and/or W: 0.1–1.0%, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+1)×(3.5[Mn]+1)×(2.2[Cr]+1)×(0.4[Ni]+1)×(3[Mo]+1) in which [element] represents mass 6 of the element, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

24. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%, and

Co: 0.1–3.0% and/or W: 0.1–1.0%, the balance being essentially Fe and inevitable impurities, wherein said elements satisfy the following requirement:

$$2.5 \leqq (FP) \leqq 4.5 \quad \text{(Ia)}$$

where FP=(0.23[C]+0.1)×(0.7[Si]+1)×(3.5[Mn]+1)×(2.2[Cr]+1)×(0.4[Ni]+1)×(3[Mo]+1) in which [element] represents mass % of the element, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

25. A spring steel of high strength and high corrosion resistance according to claim 24, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

26. A spring steel of high strength and high corrosion resistance according to claim 23, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

27. A spring steel of high strength and high corrosion resistance according to claim 24, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

28. A spring steel of high strength and high corrosion resistance according to claim 27, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

29. A spring steel of high strength and high corrosion resistance containing:

C: 0.3–0.49 mass % (hereinafter, referred to as %),

Si: 1.0–3.0%,

Mn: 0.1–0.56,

Cr: 0.5–1.5%,

Ni: 1.0% or less (excluding 0%) and/or Mo: 0.1–0.5%,

Cu: 0.1–1.0%, and

Co: 0.1–3.0% and/or W: 0.1–1.0%, the balance being essentially Fe and inevitable impurities, wherein said elements satisfy the following requirement:

$$2.5 \leqq (FP) \leqq 4.5 \quad \text{(Ia)}$$

where $FP=(0.23[C]+0.1)\times(0.7[Si]+1)\times(3.5[Mn]+1)\times(2.2[Cr]+1)\times(0.4[Ni]+1)\times(3[Mo]+1)$ in which [element] represents mass % of the element.

30. A spring steel of high strength and high corrosion resistance according to claim 29, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

31. A spring steel of high strength and high corrosion resistance according to claim 29, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

32. A spring steel of high strength and high corrosion resistance according to claim 30, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

33. A spring steel of high strength and high corrosion resistance according to claim 30, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

34. A spring steel of high strength and high corrosion resistance according to claim 31, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

35. A spring steel of high strength and high corrosion resistance according to claim 34, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

36. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%,

Co: 0.1–3.0% and/or W: 0.1–1.0%, and at least one element selected from a group consisting of 0.01–0.5% of V, 0.01–1.0% of Nb, 0.01–1.0% of Al and 0.01–1.0% of Ti, the balance being essentially Fe and inevitable impurities, wherein said elements satisfy the following requirement:

$$2.5 \leqq (FP) \leqq 4.5 \quad \text{(Ia)}$$

where $FP=(0.23[C]+0.1)\times(0.7[Si]+1)\times(3.5[Mn]+1)\times(2.2[Cr]+1)\times(0.4[Ni]+1)\times(3[Mo]+1)$ in which [element] represents mass % of the element.

37. A spring steel of high strength and high corrosion according resistance according to claim 36, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

38. A spring steel of high strength and high corrosion resistance according to claim 36, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

39. A spring steel of high strength and high corrosion according resistance according to claim 38, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

40. A spring steel of high strength and high corrosion resistance according to claim 37, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

41. A spring steel of high strength and high corrosion resistance according to claim 38, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

42. A spring steel of high strength and high corrosion according resistance according to claim 41, wherein the tensile strength after hot rolling is 1350 MPa or less; 900 or more of a cross-section of the metal structure comprises a ferrite/pearlite structure or pearlite structure; and the nodule size number of said pearlite structure is 6 or more.

43. A spring steel of high strength and high corrosion resistance according to claim 36, which further contains 0.1–1.0% of Cu.

44. A spring steel of high strength and high corrosion according resistance according to claim 43, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

45. A spring steel of high strength and high corrosion resistance according to claim 43, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

46. A spring steel of high strength and high corrosion resistance according to claim 45, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

47. A spring steel of high strength and high corrosion resistance according to claim 44, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

48. A spring steel of high strength and high corrosion resistance according to claim 45, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

49. A spring steel of high strength and high corrosion resistance according to claim 48, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

50. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%, and at least one element selected from a group consisting of 0.001–0.1% of Ca, 0.001–1.0% of La, and 0.001–1.0% of Ce for further enhancing the corrosion resistance, the balance being essentially Fe and inevitable impurities, wherein said elements satisfy the following requirement:

$$2.5 \leqq (FP) \leqq 4.5 \quad \text{(Ia)}$$

where $FP=(0.23[C]+0.1)\times(0.7[Si]+1)\times(3.5[Mn]+1)\times(2.2[Cr]+1)\times(0.4[Ni]+1)\times(3[Mo]+1)$ in which [element] represents mass % of the element, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

51. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5%, and at least one element selected from a group consisting of 0.001–0.1 of Ca, 0.001–1.0% of La, and 0.001–1.0% of Ce for further enhancing the corrosion resistance, the balance being essentially Fe and inevitable impurities, wherein said elements satisfy the following requirement:

$$2.5 \leqq (FP) \leqq 4.5 \quad \text{(Ia)}$$

where $FP=(0.23[C]+0.1)\times(0.7[Si]+1)\times(3.5[Mn]+1)\times(2.2[Cr]+1)\times(0.4[Ni]+1)\times(3[Mo]+1)$ in which [element] represents mass % of the element, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

52. A spring steel of high strength and high corrosion resistance according to claim 50, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

53. A spring steel of high strength and high corrosion resistance according to claim 50, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

54. A spring steel of high strength and high corrosion resistance according to claim 51, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

55. A spring steel of high strength and high corrosion resistance according to claim 54, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

56. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.56,

Ni: 1.0% or less (excluding 0%) and/or Mo: 0.1–0.5%,

Cu: 0.1–1.0%, and at least one element selected from a group consisting of 0.001–0.1% of Ca, 0.001–1.0% of La, and 0.001–1.0% of Ce for further enhancing the corrosion resistance, the balance being essentially Fe and inevitable impurities, wherein said elements satisfy the following requirement:

$$2.5 \leqq (FP) \leqq 4.5 \quad \text{(Ia)}$$

where $FP=(0.23[C]+0.1)\times(0.7[Si]+1)\times(3.5[Mn]+1)\times(2.2[Cr]+1)\times(0.4[Ni]+1)\times(3[Mo]+l)$ in which [element] represents mass % of the element.

57. A spring steel of high strength and high corrosion resistance according to claim 56, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

58. A spring steel of high strength and high corrosion resistance according to claim wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

59. A spring steel of high strength and high corrosion resistance according to claim 58, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

60. A spring steel of high strength and high corrosion resistance according to claim 57, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

61. A spring steel of high strength and high corrosion resistance according to claim 58, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

62. A spring steel of high strength and high corrosion resistance according to claim 61, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

63. A spring steel of high strength and high corrosion resistance containing:

C: 0.3–0.49 mass a (hereinafter, referred to as %),

Si: 1.0–3.0%,

Mn: 0.1–0.5%,

Cr: 0.5–1.5%,

Ni: 1.0% or less (excluding 0%) and/or Mo: 0.1–0.5, at least one element selected from a group consisting of 0.001–0.1% of Ca, 0.001–1.0% of La, and 0.001–1.0% of Ce for further enhancing the corrosion resistance, and at least one element selected from a group consisting of 0.01–0.5% of V, 0.01–1.0% of Nb, 0.01–1.0% of Al and 0.01–1.0% of Ti, the balance being essentially Fe and inevitable impurities, wherein said elements satisfy the following requirement:

$$2.5 \leqq (FP) \leqq 4.5 \quad \text{(Ia)}$$

where $FP=(0.23[C]+0.1)\times(0.7[Si]+1)\times(3.5[Mn]+1)\times(2.2[Cr]+1)\times(0.4[Ni]+1)\times(3[Mo]+1)$ in which [element] represents mass % of the element.

64. A spring steel of high strength and high corrosion resistance according to claim 63, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

65. A spring steel of high strength and high corrosion resistance according to claim 63, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

66. A spring steel of high strength and high corrosion according resistance according to claim 65, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

67. A spring steel of high strength and high corrosion resistance according to claim 64, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

68. A spring steel of high strength and high corrosion resistance according to claim 65, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

69. A spring steel of high strength and high corrosion resistance according to claim 68, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

70. A spring steel of high strength and high corrosion resistance according to claim 63, which further contains 0.1–1.0% of Cu.

71. A spring steel of high strength and high corrosion resistance according to claim 70, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

72. A spring steel of high strength and high corrosion resistance according to claim 70, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

73. A spring steel of high strength and high corrosion resistance according to claim 72, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

74. A spring steel of high strength and high corrosion resistance according to claim 71, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

75. A spring steel of high strength and high corrosion resistance according to claim 72, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

76. A spring steel of high strength and high corrosion resistance according to claim 75, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

77. A spring steel of high strength and high corrosion resistance containing:

C: 0.3–0.49 mass % (hereinafter, referred to as %),

Si: 1.0–3.0%,

Mn: 0.1–0.5%,

Cr: 0.5–1.5%,

Ni: 1.0% or less (excluding 0) and/or Mo: 0.1–0.5%,

Co: 0.1–3.0 and/or W: 0.1–1.0%, and at least one element selected from a group consisting of 0.001–0.1% of Ca, 0.001–1.0% of La, and 0.001–1.0% of Ce for further enhancing the corrosion resistance, the balance being essentially Fe and inevitable impurities, wherein said elements satisfy the following requirement:

$$2.5 \leqq (FP) \leqq 4.5 \quad \text{(Ia)}$$

where $FP=(0.23[C]+0.1)\times(0.7[Si]+1)\times(3.5[Mn]+1)\times(2.2[Cr]+1)\times(0.4[Ni]+1)\times(3[Mo]+1)$ in which [element] represents mass % of the element.

78. A spring steel of high strength and high corrosion resistance according to claim 77, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

79. A spring steel of high strength and high corrosion resistance according to claim 77, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

80. A spring steel of high strength and high corrosion resistance according to claim 79, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

81. A spring steel of high strength and high corrosion resistance according to claim 78, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

82. A spring steel of high strength and high corrosion resistance according to claim 79, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

83. A spring steel of high strength and high corrosion resistance according to claim 82, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

84. A spring steel of high strength and high corrosion resistance according to claim 77, which further contains 0.1–1.0% of Cu.

85. A spring steel of high strength and high corrosion resistance according to claim 84, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

86. A spring steel of high strength and high corrosion resistance according to claim 84, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

87. A spring steel of high strength and high corrosion resistance according to claim 86, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

88. A spring steel of high-strength and high corrosion resistance according to claim 85, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

89. A spring steel of high strength and high corrosion resistance according to claim 86, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

90. A spring steel of high strength and high corrosion resistance according to claim 89, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

91. A spring steel of high strength and high corrosion resistance according to claim 77, which further contains at least one element selected from a group consisting of 0.01–0.5% of V, 0.01–1.0% of Nb, 0.01–1.0% of Al and 0.01–1.0% of Ti.

92. A spring steel of high strength and high corrosion resistance according to claim 91, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

93. A spring steel of high strength and high corrosion resistance according to claim 91, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

94. A spring steel of high strength and high corrosion resistance according to claim 93, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

95. A spring steel of high strength and high corrosion resistance according to claim 92, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

96. A spring steel of high strength and high corrosion resistance according to claim 93, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

97. A spring steel of high strength and high corrosion resistance according to claim 96, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

98. A spring steel of high strength and high corrosion resistance according to claim 91, which further contains 0.1–1.0% of Cu.

99. A spring steel of high strength and high corrosion resistance according to claim 98, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

100. A spring steel of high strength and high corrosion resistance according to claim 98, wherein said spring steel is a steel bar or steel wire, and the composition also satisfies the following requirement:

$$2.0 \leqq (FP/\log D) \leqq 4.0 \quad \text{(Ib)}$$

where D is a diameter (mm) of said steel bar or steel wire after hot rolling.

101. A spring steel of high strength and high corrosion resistance according to claim 100, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

102. A spring steel of high strength and high corrosion resistance according to claim 99, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

103. A spring steel of high strength and high corrosion resistance according to claim 100, wherein the rolling starting temperature upon hot rolling is in the range from 850° to 1050° C.; the cooling starting temperature after hot rolling is in the range from 700° to 900° C.; and the average cooling rate in the region from said cooling starting temperature to 500° C. is in the range from 0.5° to 3.0° C./sec.

104. A spring steel of high strength and high corrosion resistance according to claim 103, wherein the tensile strength after hot rolling is 1350 MPa or less; 90% or more of a cross-section of the metal structure comprises a ferrite/pearlite structure or pearlite structure; and the nodule size number of said pearlite structure is 6 or more.

* * * * *